United States Patent [19]

Freeman

[11] Patent Number: 4,462,178

[45] Date of Patent: Jul. 31, 1984

[54] DISPLAY STRUCTURE FORMED OF A UNITARY BLANK

[76] Inventor: Sandra D. Freeman, P.O. Box 943, San Luis Obispo, Calif. 93406

[21] Appl. No.: 462,692

[22] Filed: Jan. 31, 1983

Related U.S. Application Data

[63] Continuation-in-part of Ser. No. 284,722, Jul. 20, 1981, Pat. No. 4,382,344.

[51] Int. Cl.[3] ..... G09F 1/08

[52] U.S. Cl. ..... 40/539; 40/124.1

[58] Field of Search ..... 40/124.1, 539, 120, 40/584; 248/459

[56] References Cited

U.S. PATENT DOCUMENTS 3,203,124 8/1965 Stoessel ..... 40/124.1

3,273,272 9/1966 Paige ..... 40/124.1

FOREIGN PATENT DOCUMENTS 962450 7/1964 United Kingdom ..... 40/124.1

1305201 1/1973 United Kingdom ..... 40/124.1

*Primary Examiner*—Gene Mancene

*Assistant Examiner*—Wenceslao J. Contreras

*Attorney, Agent, or Firm*—John T. Matlago

[57] ABSTRACT

A display structure is formed by cutting and scoring a unitary blank of sheet material to include body panels, joining flaps, dividers and cutout corner viewing windows thereon. The unitary blank is folded in a standard folding and gluing machine to provide a flat structure which upon being erected forms four display boxes which are connected in series by joining flaps located at their diagonally opposite corners. A cutout corner viewing window or a corner viewing window created by forming a divider may be provided on the front adjacent body panels provided on the blank for selected ones of the boxes in the series. Such a structural arrangement enables the display boxes to be nested together to form a single carton with the corner viewing windows enclosed therein.

5 Claims, 6 Drawing Figures

DISPLAY STRUCTURE FORMED OF A UNITARY BLANK

CROSS REFERENCE TO RELATED APPLICATION

This application is a continuation-in-part of application Ser. No. 284,722, filed July 20, 1981 and now U.S. Pat. No. 4,382,344.

BACKGROUND OF THE INVENTION

The present invention relates to display structures for use in containing and displaying articles and more particularly to improvements in constructional features thereof.

In the aforementioned application, a display structure is disclosed which is formed of a unitary blank of sheet material which has been cut and scored in such a manner that, upon being passed through a folding and gluing machine, a flat assembly is provided which upon being erected provides a plurality of display boxes connected in series by their diagonally opposite corners.

SUMMARY OF THE INVENTION

In accordance with the present invention, a unitary blank of sheet material is cut and scored to form four display boxes connected in series by joining flaps located at their diagonally opposite corners. Adjacent body panels provided on the unitary blank for forming a nonjoining corner of a box are provided with a cutout corner viewing window or a corner viewing window in combination with a divider for the box. When the corner viewing windows are provided on the adjacent front body panels of the boxes, the series of boxes can be nested together to form a single carton with the corner viewing windows enclosed therein.

BRIEF DESCRIPTION OF THE DRAWINGS

The above and other features and advantages of the present invention will become more readily apparent from the following description reference being made to the accompanying drawings in which.

DESCRIPTION OF THE PREFERRED EMBODIMENT

Figure 1:
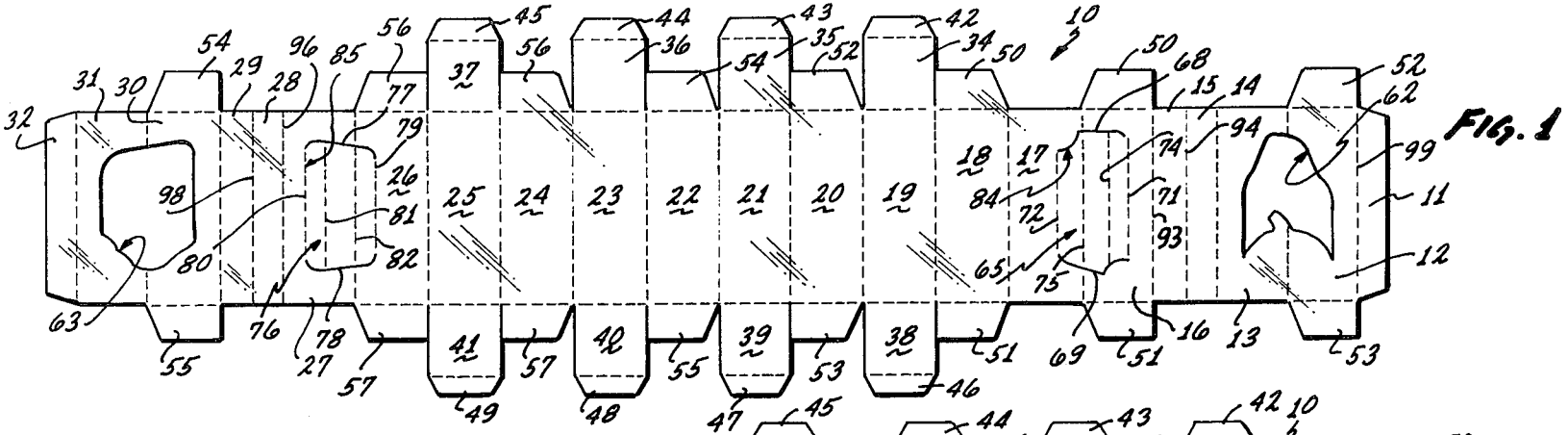
FIG. 1 shows a unitary blank of sheet material which has been cut and scored for providing a series of four corner connected boxes having constructional features in accordance with the present invention.

Referring to FIG. 1, a plan view is shown of a unitary blank 10 of cardboard. The unitary blank 10 is cut and scored to sequentially include starting from the right end thereof a first narrow end flap 11, body panels 12 and 13, a first pair of narrow tabs 14 and 15, body panels 16, 17, 18, 19, 20, 21, 22, 23, 24, 25, 26 and 27, a second pair of narrow tabs 28 and 29, body panels 30 and 31, and a second narrow end flap 32. All the body panels on the unitary blank 10 are rectangularly shaped and of the same size, and each of the first pair of tabs 14, 15, the second pair of tabs 28 and 29, the first end flap 11 and the second end flap 32 on the unitary blank 10 are all of the same length as the body panels but approximately one third the width thereof.

The body panels 19, 21, 23 and 25 are respectively provided with top covers 34, 35, 36 and 37 and bottom covers 38, 39, 40 and 41. In addition, the ends of the top covers 34, 35, 36 and 37 are respectively provided with tuck-in flaps 42, 43, 44 and 45 and the ends of the bottom covers 38, 39, 40 and 41 are respectively provided with tuck-in flaps 46, 47, 48 and 49. Each of the body panels 16 and 18 is provided with a top flap 50 and a bottom flap 51, each of the body panels 12 and 20 is provided with a top flap 52 and a bottom flap 53, each of the body panels 22 and 30 is provided with a top flap 54 and a bottom flap 55, and each of the body panels 24 and 26 is provided with a top flap 56 and a bottom flap 57.

In addition, a first corner viewing window 62 is cut to include portions of adjacent panels 12 and 13 and a second corner viewing window 63 is cut to include portions of adjacent panels 30 and 31. Also, a first divider 65 is formed between and intermediate the top and the bottom of the body panels 16 and 17 by providing spaced vertical score lines 71 and 74 on the body panel 16 and a vertical score line 72 on the body panel 17 and by joining the upper ends of score lines 71 and 72 by a generally horizontal slit 68 and by joining the lower ends of score lines 71 and 72 by a generally horizontal slit 69.

In a similar fashion, a second divider 76 is formed between and intermediate the top and the bottom of the body panels 26 and 27 by providing spaced vertical score lines 80 and 81 on the body panel 27 and a vertical score line 79 on the body panel 26 and by joining the upper ends of score lines 79 ad 80 by a generally horizontal slit 77 and by joining the lower ends of score lines 79 and 80 by a generally horizontal slit 78.

The unitary blank 10 of cardboard cut and scored as shown in FIG. 1 is formed into the flat box assembly of the present invention by feeding it broadside through a standard folding and gluing machine.

Thus, as the blank 10 is advanced through the folding and gluing machine, to form the first corner joining flap 90, the right end portion thereof is first folded inwardly along score line 93 so as to lie flat in the plane of the blank. A glue is then applied to the exposed surface of the tab 15 and the right end portion is then folded back outwardly along score line 94 so as to lie flat in the plane of the blank 10.

To form the second corner joining flap 91, the left end portion of the blank 10 is first folded inwardly along score line 96 so as to lie flat in the plane of the blank. A glue is then applied to the exposed surface of the tab 28 and then the left end portion is folded back outwardly along the score line 98 so as to lie flat in the plane of the blank.

It should be appreciated that when the respective pairs of tabs used to form the joining flaps 90 and 91 are located relatively near the opposite ends of the blank 10, as in the embodiment of the present invention, the folding of the right and left end portions of the blank 10 to form the respective joining flaps 90 and 91 can be carried out simultaneously while the blank 10 is being advanced through the folding and gluing machine.

After forming the first and second joining flaps 90 and 91, as the blank 10 continues to advance, the first end flap 11 is folded along score line 99 to lie flat over the body panel 12. A glue is then applied on the exposed surfaces of the first end flap 11, the second end flap 32, the tab 14 on the first joining flap 90, and the tab 29 on the second joining flap 91.

Figure 2:
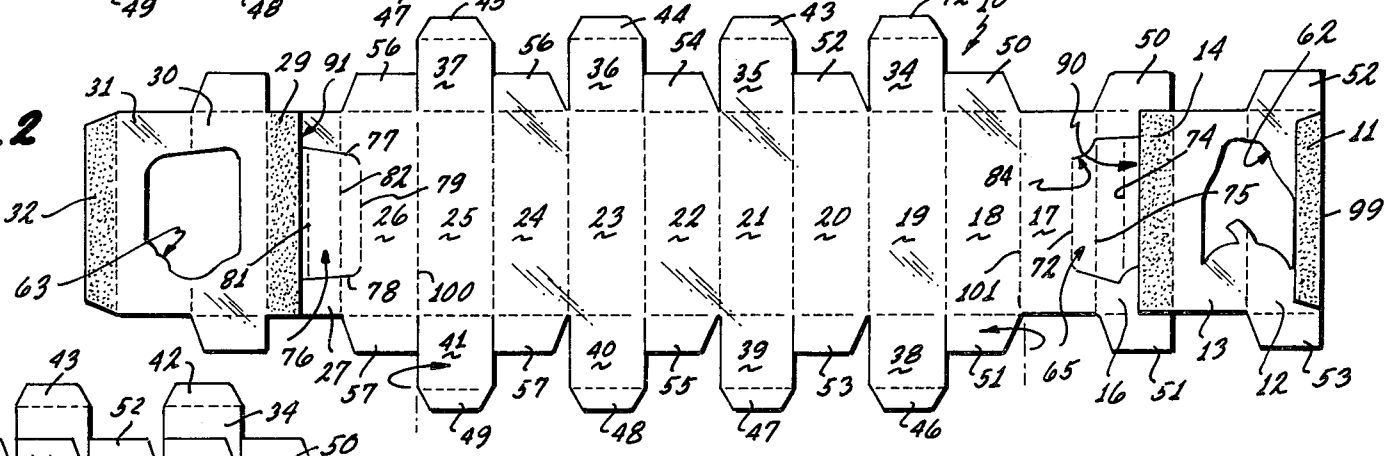
FIG. 2 shows the unitary blank of FIG. 1 after being folded to form joining flaps and having glue applied to the joining flaps and the end flaps.
Figure 3:
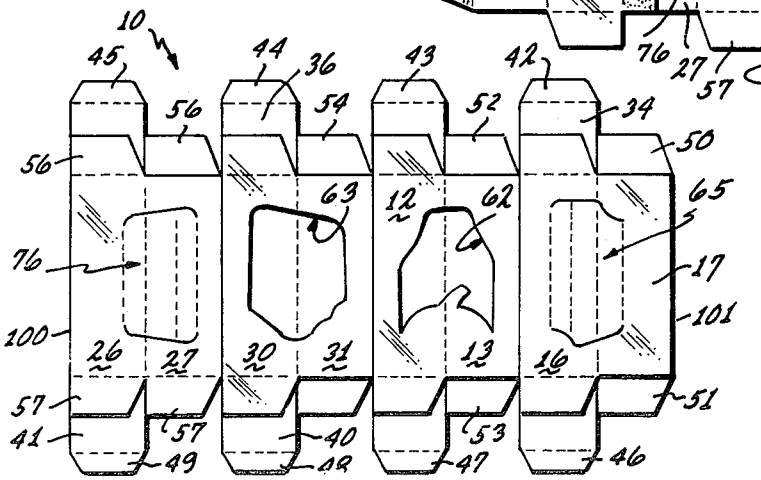
FIG. 3 shows the folded unitary blank in FIG. 2 after being further folded to provide a flat box assembly.

The advancing blank 10, as now folded and glued as shown in FIG. 2, next has its left end portion folded inwardly on score line 100 such that body panels 26, 27, 30 and 31 lie flat over the body panels 25, 24, 23 and 22, respectively, and the second end flap 32 lies over the left marginal portion of the body panel 21. Then the right end portion of the blank 10 is folded inwardly on score line 101 such that the body panels 17, 16, 13 and 12 lie flat over body panels 18, 19, 20 and 21, respectively, as illustrated in FIG. 3. As a result, the tab 14 of the first joining flap 90 is glued to the left marginal side of panel 19, the tab 29 of the second joining flap 91 is glued to the right marginal side of the panel 24, and the first end flap 11 is glued up against the back of the second end flap 32 which is, in turn, glued up against the right marginal side of panel 21. It should now be evident that the first and second end flaps 11 and 32 form a third corner joining flap 97.

Figure 4:
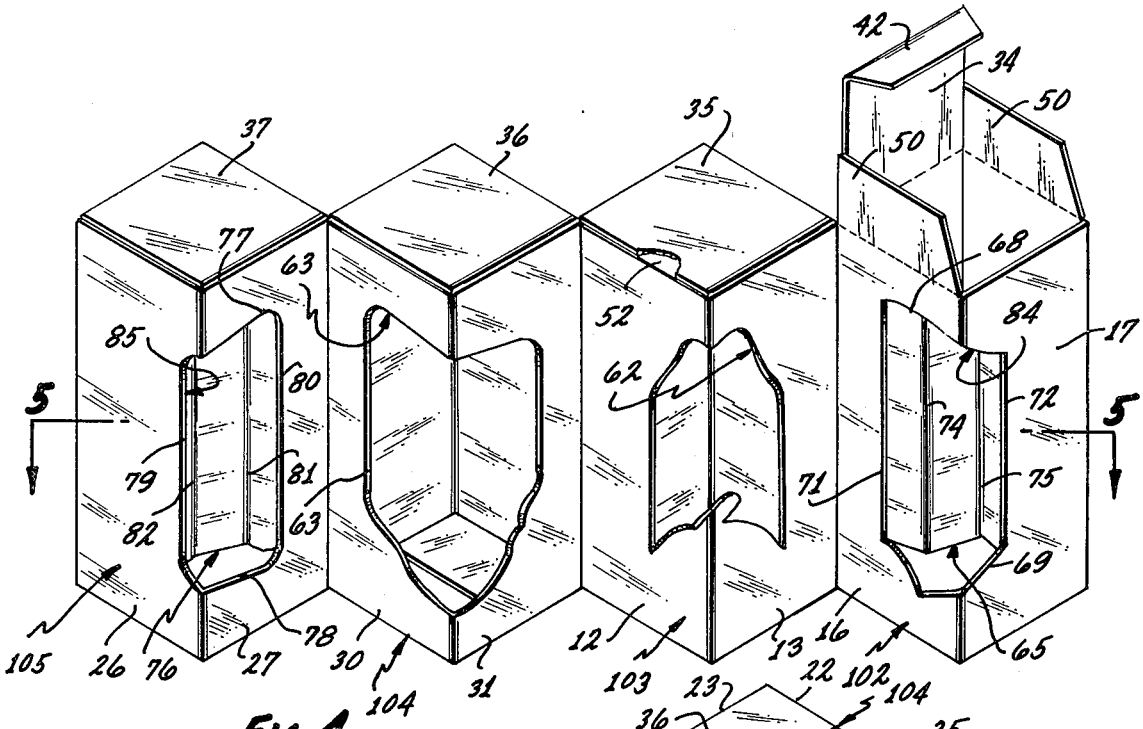
FIG. 4 shows the flat box assembly in FIG. 3 after being erected to form the series of four corner connected boxes of the present invention.
Figure 5:
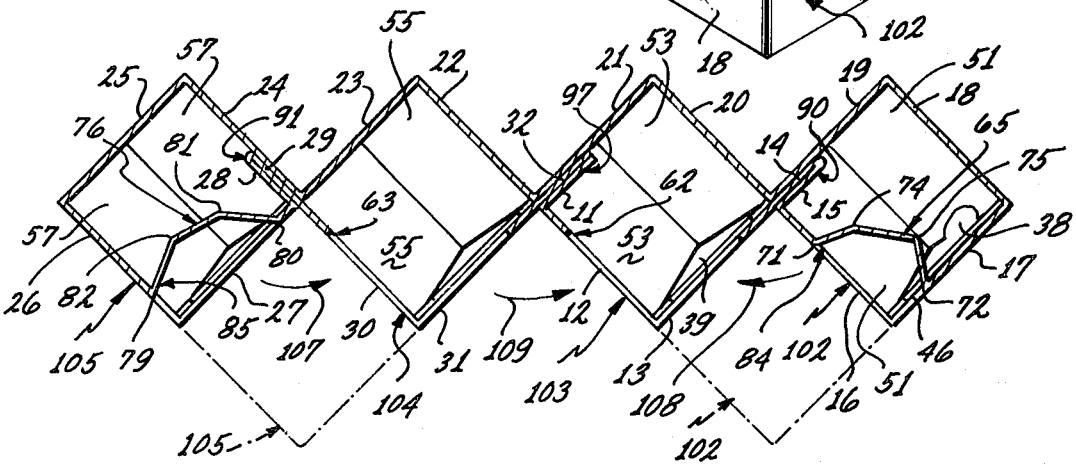
FIG. 5 shows a cross sectional view of the erected four box series as taken on line 5—5 of FIG. 4.

FIG. 4 shows a front view of the erected assembly of four boxes 102, 103, 104 and 105 formed from the flat box assembly in FIG. 3, and FIG. 5 shows a cross sectional view of FIG. 4 as taken on line 5—5 thereof. Thus, as best seen in FIG. 5, the bottom flaps 51, 53, 55 and 57 and the bottom covers 38, 39, 40 and 41 of the respective boxes 102, 103, 104 and 105 are folded to cover the bottom thereof and held in position by the tuck-in-flaps 46, 47, 48 and 49, respectively. FIG. 4 shows the top flaps 50 and the top cover 34 with tuck-in flap 42 in open position on the top of box 102 and also shows the top covers 35, 36, and 37 already folded over the top flaps 52, 54, and 56 of the respective boxes 103, 104 and 105 to cover the top openings thereof and held in position by tuck-in flaps 43, 44 and 45, respectively.

As shown in FIGS. 4 and 5, upon erecting the flat box assembly shown in FIG. 3 the divider 65 on box 102 is pushed inwardly and folded along its vertical score lines 71, 74, 75 and 72. Likewise, the divider 76 on box 105 is pushed inwardly and folded along its vertical score lines 79, 82, 81 and 80.

It should be particularly noted in FIG. 5 that the joining flaps 90, 91 and 97 are glued to the respective rear panels 19, 24 and 21 of the boxes 102, 105 and 103. Furthermore, the corner cutout viewing windows 62 is located on the front panels 12 and 13 of box 103 and the corner cutout viewing window 63 is located on the front panels 30 and 31 of box 104. Moreover, the corner viewing window 84 resulting from the pushing in of the divider 65 is located on the front panels 16 and 17 of the box 102 and the corner viewing window 85 resulting from pushing in the divider 76 is located in the front panels 26 and 27 of the box 105.

Gluing the joining flaps 91, 92 and 97 against the rear panels of the boxes assures that they do not interfere with the cutout corner viewing windows or the corner viewing windows formed by the dividers on the front body panels thereof.

It should now be clear that the erected four box assembly shown in FIG. 4 can be used to display articles being contained in the individual boxes 103 and 104 through the cutout corner viewing windows 62 and 63, respectively, and also in the individual boxes 102 and 105 through the corner viewing windows 84 and 85, respectively, formed by the inwardly folded dividers 65 and 76. It should be appreciated that each of the dividers 65 and 76 can be especially shaped to snugly accomodate articles of various cross sectional sizes in the compartments they form in the respective boxes 102 and 105 by varying the number and the locations of the vertical score lines provided on the adjacent body panels of the unitary blank used to form each divider.

Figure 6:
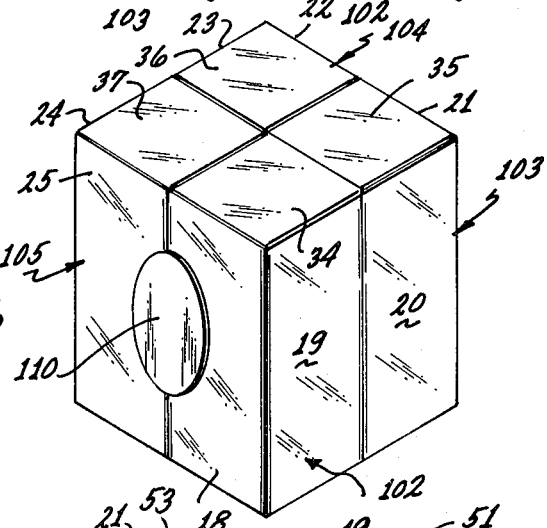
FIG. 6 shows the series of four boxes in FIG. 4 after the individual boxes thereof have been nested against each other and held in position by a gummed label to form a single carton.

Once the erected four box assembly shown in FIG. 4 has been filled with articles, in order to ship or store the box assembly the end box 105 is rotated as indicated by arrow 107 in FIG. 5 such that its body panel 27 lies against the body panel 30 of the box 104, and the end box 102 is rotated as indicated by the arrow 108 such that its body panel 16 lies against the body panel 13 of the box 103. The boxes 105 and 104 are then rotated inwardly toward the boxes 102 and 103 as indicated by arrow 109 such that the body panel 31 of box 104 lies against the body panel 12 of box 103 and the body panel 26 of box 105 lies against the body panel 17 of box 102. As shown in FIG. 6, the assembly of four display boxes now form a single rectangularly shaped carton held together by a gummed label 110 with the individual boxes effectively forming quarter sections thereof.

It should now be especially noted that the outside surface of the single carton formed by the nesting of the four box assembly comprises successive body panels 18, 19, 20, 21, 22, 23, 24, and 25 on the unitary blank 10 with the end panels 18 and 25 thereof being joined together by the gummed label 110. Moreover, the joining flaps 90, 91, and 97, the cutout viewing windows 62 and 63, and the corner viewing windows 84 and 85 created by pushing in the dividers 65 and 76 are all enclosed within the interior of the single carton formed by the nested assembly of four boxes. It should now be evident that the assembly of four nested boxes filled with articles can be sold as a single carton, as shown in FIG. 6, and the purchaser, upon removing the gummed label 110 and opening up the assembly of boxes can view the articles displayed therein as shown in FIG. 4.

While the embodiment of the invention shown and described herein is well adapted to fulfill the intended function and advantages previously mentioned as desirable, it is to be understood that the invention is not limited to the specific features shown and described but that the means and configuration herein disclosed are susceptible of modification in form, materials, proportions and arrangements of parts without departing from the principles involved or sacrificing any of its advantages and the invention therefore may be embodied in various forms within the scope of the appended claims.

What is claimed is:

1. A structure formed of a unitary blank of sheet material for containing and displaying articles, said structure comprising:

a series of four rectangular boxes;

each said box having the sidewalls thereof formed from body panels defined on said blank;

each of the two middle boxes in the series having diagonally opposite corners thereof respectively joined to a corner of an adjacent box in the series by a joining flap formed by gluing together narrow portions defined on said unitary blank and disposed between two of the body panels forming a joining corner, and each said joining flap having one of its surfaces glued to one of the other two body panels forming the joining corner; and a divider together with a corner viewing window formed for at least one box in the series by providing at least one vertical score line intermediate the top and bottom of each of the adjacent body panels provided on the unitary blank for forming a nonjoining corner of said box and providing a generally horizontally slit between each of the upper and lower ends of said vertical score lines.

2. A structure formed of a unitary blank of sheet material for containing and displaying articles as defined in claim 1 wherein a corner viewing window is formed for at least one other box in the series by cutting out portions of adjacent body panels provided on the unitary blank for forming a nonjoining corner of said other box.

3. A structure formed of a unitary blank of sheet material for containing and displaying articles as defined in claim 1 wherein said series of four rectangular boxes are nested together to form a single rectangular carton with the corner viewing windows provided on the boxes enclosed within the sidewalls of the carton.

4. A structure as defined in claim 3 wherein the sidewalls of said rectangular carton comprise a series of adjacent body panels on the unitary blank, and means for joining the end body panels forming the sidewalls of said carton to hold said nested boxes together.

5. A structure formed of a unitary blank of sheet material for containing and displaying articles, said structure comprising:

a series of rectangular boxes;

each said box having the sidewalls thereof formed from body panels defined on said blank;

each of the middle boxes in the series having diagonally opposite corners thereof respectively joined to a corner of an adjacent box in the series by a joining flap formed by gluing together narrow portions defined on said unitary blank and disposed between two of the body panels forming a joining corner, and each said joining flap having one of its surfaces glued to one of the other two body panels forming the joining corner; and a divider together with a corner viewing window formed for at least one box in the series by providing a single vertical score line intermediate the top and bottom of one front body panel provided on the unitary blank for said box and providing a pair of spaced vertical score lines intermediate the top and bottom of the other front body panel provided on the unitary blank for said box and providing a generaly horizontal slit between each of the upper and lower ends of said single vertical score line on said one front body panel and the furthermost spaced vertical score line on said other front body panel.

* * * * *